United States Patent [19]

Kuusisto

[11] Patent Number: 5,048,577

[45] Date of Patent: Sep. 17, 1991

[54] FUEL DISPENSING VAPOR ELIMINATING VALVE

[76] Inventor: James Kuusisto, P.O. Box 206, Calumet, Mich. 49913

[21] Appl. No.: 447,399

[22] Filed: Dec. 7, 1989

[51] Int. Cl.[5] ..... B65B 3/04; B67C 3/00

[52] U.S. Cl. ..... 141/293; 137/595; 137/601; 141/59; 141/302; 141/351; 141/291; 251/149.2

[58] Field of Search ..... 141/290, 291, 292, 293, 141/294, 59, 301, 302, 44, 45, 46, 305, 387, 388, 389, 351; 251/149.2; 137/595, 601

[56] References Cited

U.S. PATENT DOCUMENTS

| | | | |
|---|---|---|---|
| 167,211 | 8/1875 | Baker | 137/595 |
| 1,014,328 | 1/1912 | Podlesák | 137/601 |
| 3,133,566 | 5/1964 | Hoss | 141/384 |
| 3,847,210 | 11/1974 | Wells | 137/601 |
| 4,202,385 | 5/1980 | Voelz et al. | 141/59 |
| 4,211,263 | 7/1980 | Kennedy et al. | 141/83 |
| 4,354,536 | 10/1982 | Moss | 141/383 |
| 4,533,113 | 8/1985 | Francart, Jr. | 137/595 |

FOREIGN PATENT DOCUMENTS

| | | | |
|---|---|---|---|
| 19069 | 4/1891 | United Kingdom | 251/149.2 |

*Primary Examiner*—Henry J. Recla
*Assistant Examiner*—Keith Kupferschmid
*Attorney, Agent, or Firm*—John J. Cantarella

[57] ABSTRACT

A cylindrical valve having a fuel dispensing passage and a vapor receiving passage therein which are both simultaneously blocked or unblocked by butterfly valves controlled by a plunger which protrudes from one end of the cylinder and has a rack defined thereon which engages with pinion gears which in turn engage two valve shafts and rotate the valve plates. A spring or similar biasing element moves the plunger to the position under which the valve plates close the passages whenever the plunger is not forcibly depressed against the spring.

5 Claims, 1 Drawing Sheet

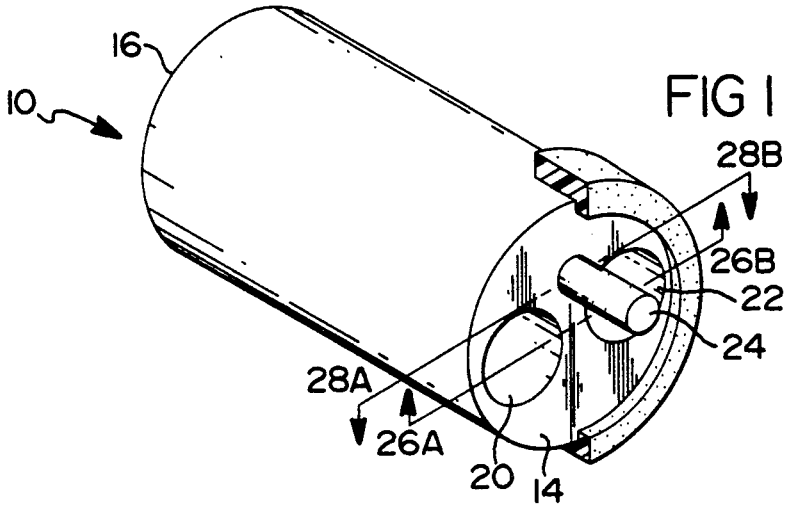
FIG 1
FIG 2
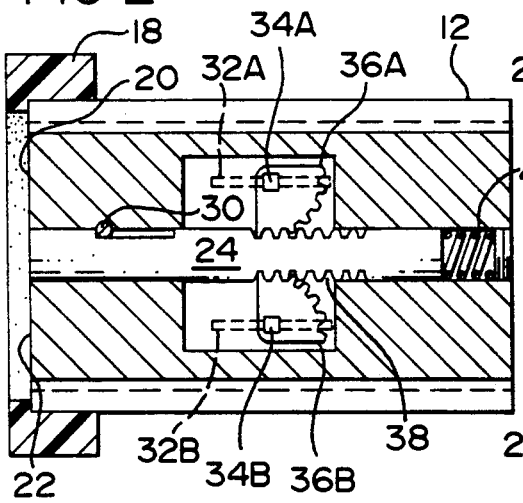
FIG 3
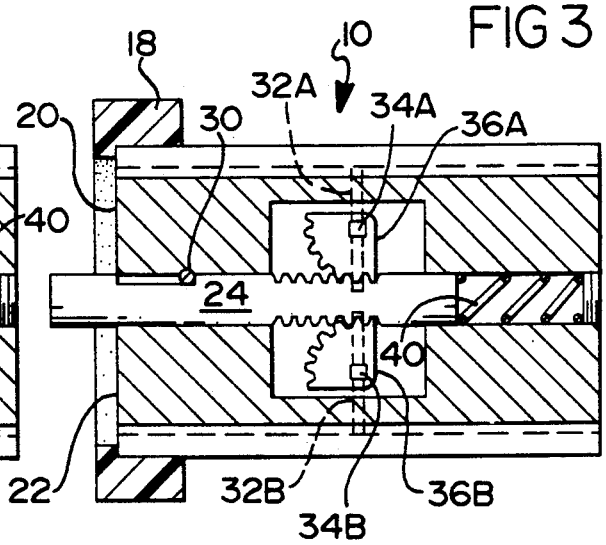
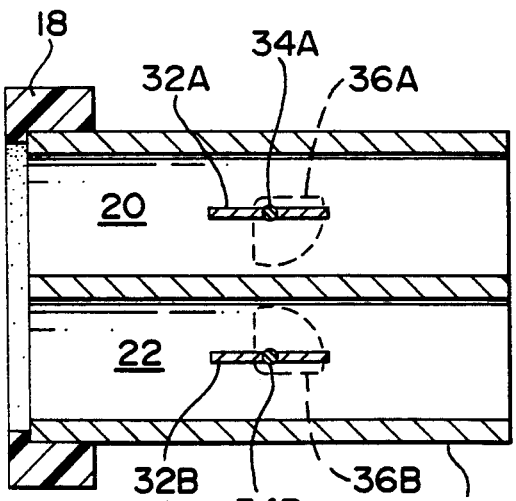
FIG 4
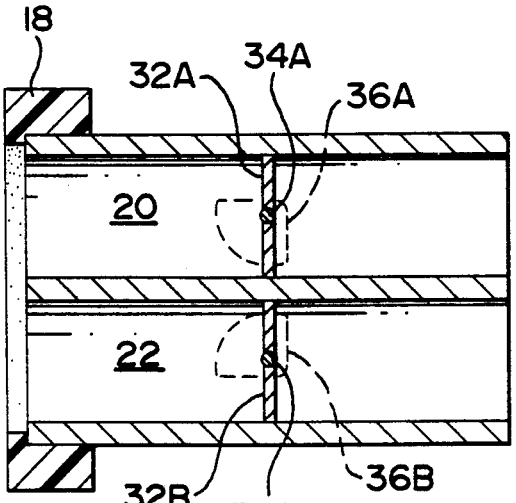
FIG 5

FUEL DISPENSING VAPOR ELIMINATING VALVE

BACKGROUND OF THE INVENTION

1. Field of the Invention

The present invention relates generally to apparatus used to eliminate fuel vapors commonly emitted from fuel tanks and fuel dispensing nozzles during the refueling process. Specifically, the present apparatus disclosed herein is a valve which may be adapted to fuel dispensing nozzles either formed as an integral part thereof or threaded therein which will allow the user to easily dispense fuel and syphon off the vapors which are emitted during that process.

2. Description of the Relevant Art

The relevant art includes U.S. Pat. No. 3,133,566, issued in 1964 to Hoss entitled: "Fueling Device", which discloses fueling device for feeding liquid fuel from a gas pump to a fuel tank vehicle including, a gas pump, a filling hose extending from and connected with the gas pump, a first coupling element having a first spring biased valve therein and being secured to the free end of said filling hose, a nozzle having a second coupling element and including means for opening said first spring biased valve, the first coupling element being connectable with the second coupling element simultaneously opening the first spring biased valve for a free flow of the fuel from the filling hose to the nozzle, a fuel tank adapted to be mounted in a vehicle, a filling line extending from and being secured to the fuel tank, a third coupling element having a second spring biased valve therein and secured to the free end of the filling line, and an intermediate fourth coupling element having means for opening said second spring biased valve opposite said second spring biased valve and being opened at its opposite ends, the first coupling element being connected selectively directly with the third coupling element to provide a direct connection between the first and third coupling elements and indirectly with the third coupling element by means of an intermediate connection of the first coupling element with the second coupling element and of the third coupling element with the fourth coupling element, providing an indirect connection of the first coupling element with the third coupling element, and the first valve and the second valve being opened simultaneously and the nozzle being received in the open end of the fourth coupling element during the indirect connection between the first and third coupling elements; U.S. Pat. No. 4,223,706 issued in 1980 to McGahey entitled "Closed Fuel System With Vacuum Assist", which includes a tight seal at the vehicle-nozzle interface for those vehicles which permit it, a vacuum assist device adapted to aid in collecting vapors from those vehicles the tanks of which cannot be sealably engaged, and the use of a positive displacement reciprocatory hydraulic motor which is driven by the dispensed gasoline flow, the motor thus actuates this reciprocatory vapor pump, thereby controlling the volume of vapor pumped in relation to the volume of gasoline dispensed; U.S. Pat. No. 4,354,536 issued in 1982 to Moss, entitled "Gasoline Dispensing Nozzle" discloses a nozzle having a valve housing and an elongated tube extending therefrom, the nozzle is provided with at least a slot near its open end, a latch is mounted within the nozzle which is movable between a first position, extending outwardly of the slot and a second position inwardly within the nozzle, the latch may be spring biased or normally controlled to extend outwardly, so that once inserted within the vehicle, the gas tank will lockingly engage under its lip, the latch is provided with structure operable from the exterior of the nozzle which can selectively retrack the latch and release the nozzle from the gas tank; U.S. Pat. No. 4,429,725 issued in 1984 to Walker, entitled "Dispensing Nozzle for Vacuum Assist Vapor Recovery System", discloses an automatic shut-off nozzle adapted to be utilized in a vacuum assist type vapor recovery system, including, a nozzle body having an inlet and an outlet for liquid to be dispensed, a filling spout attached to the nozzle body adapted for loose fitting reception in a vehicle tank fill pipe and having an internal conduit for liquid connecting to the body outlet and an external conduit for vapor return surrounding the liquid conduit, the two conduits defining an annular passage for conducting vapor from the vehicle tank to a vapor return conduit means in the nozzle body, a valve in the body for controlling the flow of liquid through the body from the inlet to the outlet, a manually operated means for controlling the operation of the valve and, vacuum responsive release means to allow closing of the valve and stoppage of liquid flow when a predetermined partial vacuum is induced within the nozzle, venturi means responsive to liquid flow through the body for including a partial vacuum and an interconnecting passage between the vapor return conduit means to the venturi means normally allowing the flow of vapor from the vapor return conduit means to the venturi means to limit the partial vacuum induced, thereby, and the interconnecting passage being located at a point in the vapor return conduit which becomes full of liquid at such times when liquid begins to be aspirated from the vehicle tank through the vapor return conduit, and a check valve within the nozzle body for closing the vapor return conduit valve which is actuated to the open position by liquid pressure within the nozzle body when the control valve and the nozzle body are open; and U.S. Pat. No. 4,827,987 issued in 1989 to Faeth, entitled, "Liquid Fuel Blockage Removal Device With A Venturi and bypass Passages", discloses a device for mounting in a fuel dispensing hose that has a flexible inner tube defining the fuel conduit, and a tubular outer sleeve that defines with the inner tube an annular vapor return passage, and the device includes an aspirating block adapted for serial connection with inner tube within the outer sleeve, and the section comprises a cylindrical block that is connected in series with ends of the inner tube and defines a venturi or jet pump forming part of the fuel conduit, and the block also includes bypass passages for fuel to bypass the venturi and to increase the fuel flow through the block, and the aspirating block also has radial aspirator ports which communicate between the venturi throat or jet pump and the annular vapor return passage, and each radial aspirating port includes a check valve to permit only one way fuel flow from the fuel outlet to the vapor passage.

As can be seen the aforementioned prior art while related to the present apparatus disclosed herein either deals with the problem of controlling the fueling of a tank, the dispensing of fuel and only peripherally the related problem of controlling fuel vapors by passive means if at all. However, these generally fail to disclose a simple valve which is adaptable to the conventional fuel pump found at most fuel dispensing stations which allows the collection of vapors in an amount proportional to the fuel dispensed into a fuel tank and operable by the displacement by dispensed fuel without the necessary assist of vapor pumps or a hydraulic motor. Furthermore, the relevant art fails to disclose an apparatus which will keep fuel from flowing through the fuel nozzle unless the fuel vapors can be drawn for proper disposal, provide a channel for the evaporative vapors to travel through for disposal and prevent the loss or leakage of vacuum from any fuel nozzle that is not in use that would reduce the efficiency of those that are being used. It should be noted that the present apparatus disclosed herein accomplishes all the aforementioned objectives mentioned above.

SUMMARY OF THE INVENTION

The present invention is to be used to collect, control and eliminate fuel vapors emitted from fuel pump nozzles and fuel tank filler necks or openings during the filling of a fuel tank, including, a substantially cylindrical container having a front end and a rear end, the container is further defined by a fuel dispensing passage running from the front to the rear end terminating in respective first and second apertures therein, the container is further defined by a vapor receiving passage running from the front to the rear end terminating in respective third and fourth apertures therein, first means operably engaged with the fuel dispensing and vapor receiving passages and the container for simultaneously blocking or unblocking of the passages, and a second means operably engaged with the first means for actuating same . The second means includes a plunger having a rack defined thereon as well as an indentation separate from the rack. Furthermore, the first means is to be understood to include valve plates, like butterfly valves, located in each of the passages that operates simultaneously with the action of the rack which is engaged with pinion gears which are in turn engaged with the valve. When the plunger is depressed the pinion gears connected to the valve shafts rotate and open each of the butterfly valves. Unless the valve in the fuel passage is open the automatic fuel valve will not dispense any fuel. As the fuel enters the fuel tank any evaporatives are drawn off through the vapor receiving passage. This vapor receiving passage may be connected to an evacuator hose that can deliver the vapors to a storage facility, and the vapors will be forced through this passage by the filling of the fuel tank.

It is an object of the present invention to provide a valve which may be used with all conventional service station pump nozzles without any expensive changes or modifications thereto.

It is another object of the present invention to provide a valve which may be installed by removing the nozzle portion of a conventional fuel pump and threading the valve therein, or which may simply be built as an integral part thereof.

BRIEF DESCRIPTION OF THE DRAWINGS

FIG. 1 shows invention 10 in a plan view except for the cut away portion of sealing gasket 18 on front end 14.

FIG. 2 is a cross sectional view of FIG. 1 taken along line 28*a* and 28*b* with the plunger 24 depressed.

FIG. 3 is cross sectional view taken along line 26*a* and 28*b* of FIG. 1 with the plunger portruding from front end 14.

FIG. 4 is cross-sectional view of FIG. 1 taken along line 28*a* and 26*b* of invention 10 in a nonoperational mode.

FIG. 5 is a cross-sectional view of FIG. 1 taken along line 28*a* and 26*b* of invention 10 in an operational mode.

DETAILED DESCRIPTION OF THE PREFERRED EMBODIMENT

FIG. 1 shows invention 10 having front end 14 and rear end 16. As can be seen invention 10 is shaped like a cylinder 12. It should be noted that around front end 14 is a sealing gasket 18 made of a predetermined resilient material. Sealing gasket 18 could possibly be made from rubber or like material. Additionally, invention 10 has vapor receiving passage 20 and fuel dispensing passage 22 which run the full length of invention 10 and have corresponding apertures in front end 14 and rear end 16, which are not shown. Furthermore, invention 10 as shown in FIG. 1 depicts a nonoperational mode whereby plunger 24 protrudes from front end 14.

FIG. 2 which is a cross sectional view of FIG. 1 taken across line 28*a*-28*b* shows again cylinder 12 having front end 14 rear end 16 as well as sealing gasket 18 and vapor receiving passage 20 and fuel dispensing passage 22. Additionally, plunger 24 is know shown in a recessed or operational mode and as can be seen plunger 24 is configured to have the extent of slidable movement controlled by plunger stop 30. As shown in this operational mode invention 10 has valve plates 32*a* and 32*b* in an open position allowing fuel and vapor to flow through vapor recieving passage 20 and fuel dispensing passage 22. Also, it should be noted that the plunger 24 is further configured to have a rack thereon which will engage pinion gears 36*a* and 36*b* which turn on valve shafts 34*a* and 34*b* which in turn are engaged with valve plates 32*a* and 32*b*. Return spring 40 is shown in a depressed configuration and will return plunger 24 to a protruding position as indicated in FIG. 1 when pressure is no longer applied to plunger 24. It should be understood that plunger 24 will be depressed when the valve is placed into contact with a fuel tank neck not shown. Returning briefly to FIG. 1 it should be noted that plunger 24 is positioned off center such that it may conveniently be depressed during the fueling of a fuel tank and not impede the flow of fuel or vapor.

FIG. 3 depicts the identical components as disclosed in FIG. 2 except for the fact that it shows the plunger, valve plates 32*a* and *b* in a closed position as well as pinion gears 36*a* and *b*, and return spring 40 is no longer depressed.

As can be seen FIG. 4 shows a cross-section of invention 10 taken across line 26*a*-26*b* as shown in FIG. 1. FIG. 4 shows a cross-sectional view of sealing gasket 18 on front end 14, rear end 16, valve plates 32*a* and *b*, valve shafts 38*a* and *b* and pinion gears 36*a* and *b*. FIG. 4 shows the valve plates and pinion gears in an open mode corresponding to that shown previously in FIG. 2.

FIG. 5 is a cross-section of invention 10 taken across line 26*a*–*b* as shown in FIG. 1. Additionally, FIG. 5 corresponds generally to a closed mode of invention 10 disclosing no new components and corresponds generally to FIG. 3 as previously discussed.

The aforementioned description of the preferred embodiment is not meant to be inclusive nor limiting with respect to the invention 10.

Furthermore, more complete understanding of the invention disclosed herein will be received upon review of the appended claims.

I claim:

1. An apparatus to be used to collect, control and eliminate fuel vapors emitted from a fuel pump nozzle and fuel tank filler neck or opening during the filling of a fuel tank comprising, in combination:

a substantially cylindrical container having a front end and a rear end;

said container is further defined by a fuel dispensing passage running from the front end to the rear end, terminating in respective first and second apertures therein;

said container is further defined by a vapor receiving passage running from the front end to the rear end terminating in respective third and fourth apertures;

first means operably engaged with said fuel dispensing, vapor receiving passages and said container for simultaneously blocking or unblocking of both said passages;

second means operably engaged with said first means for actuating said first means;

said container is further defined by a third passage running from the front end to the rear end terminating in respective fifth and sixth apertures;

wherein said second means is a plunger operably and slidably engaged with said third passage;

wherein said first means further includes first and second valve shafts operably engaged respectively, with the vapor receiving and fuel dispensing passages;

first and second valve plates operably engaged with the first and second valve shafts, respectively;

third means for movably and operably engaging said first valve shaft and said plunger;

fourth means for movably and operably engaging said second valve shaft and said plunger;

fifth means for limiting the slidable movement of said plunger to a pre-determined amount; and sixth means for causing the first and second valve plates to return to a closed position whenever said apparatus is not in use operably engaged with said plunger.

2. The apparatus of claim 1, further including:

a gasket around the circumference of the front end of said container made of a pre-determined resilient material.

3. The apparatus of claim 2, wherein: said third means is a first pinion gear; said fourth means is a second pinion gear; and said plunger has a rack defined thereon operably engaged with the first and second pinion gears.

4. The apparatus of claim 3, wherein: said fifth means is a stop post operably engaged with said plunger; said plunger is further defined by an indentation defined therein separate from the defined thereon; and said stop post is operably engaged with said plunger within the indentation defined therein.

5. The apparatus of claim 4, wherein:

sixth means includes resilient biasing means.

* * * * *